United States Patent [19]

Truehart

[11] Patent Number: 4,815,357

[45] Date of Patent: Mar. 28, 1989

[54] ADJUSTABLE DIVIDED FLOW SELF-LEVELING SYSTEM

[75] Inventor: David C. Truehart, Lakeville, Minn.

[73] Assignee: Lull Corp., St. Paul, Minn.

[21] Appl. No.: 76,681

[22] Filed: Jul. 21, 1987

[51] Int. Cl.[4] ..... F15B 11/00; F15B 13/00

[52] U.S. Cl. ..... 91/516; 91/513; 91/171; 91/514

[58] Field of Search ..... 91/31, 513, 515, 516, 91/517, 518, 520, 532, 421, 436, 514, 171; 414/708, 709; 137/596

[56] References Cited

U.S. PATENT DOCUMENTS

| | | | |
|---|---|---|---|
| 2,242,002 | 5/1941 | Klein | 137/166 |
| 2,306,379 | 12/1942 | Conradson | 91/532 |
| 3,023,584 | 3/1962 | Markovich | 91/532 |
| 3,073,123 | 1/1963 | Hodgson et al. | 91/520 |
| 3,161,111 | 12/1964 | Williams | 91/517 |
| 3,179,120 | 4/1965 | Erickson et al. | 137/101 |
| 3,217,726 | 11/1965 | Rohweder et al. | 91/515 |
| 3,251,277 | 5/1966 | Stacey | 91/518 |
| 3,297,183 | 1/1967 | Klaviter et al. | 414/708 |
| 3,363,516 | 1/1968 | Hubbard | 91/414 |
| 3,563,137 | 2/1971 | Graber | 91/520 |
| 3,654,835 | 4/1972 | Sievenpiper | 91/436 |
| 3,662,548 | 5/1972 | Suzuki et al. | 60/51 |
| 3,811,587 | 5/1974 | Seaberg | 414/708 |
| 3,883,023 | 5/1975 | Bernhoft | 91/517 |
| 3,973,580 | 8/1976 | Ueda | 137/101 |
| 4,058,140 | 11/1977 | Budzich | 91/421 |
| 4,070,857 | 1/1978 | Wible | 60/422 |
| 4,070,858 | 1/1978 | Hand | 60/422 |
| 4,121,601 | 10/1978 | Presley | 137/101 |
| 4,285,268 | 8/1981 | Deckler | 91/517 |
| 4,352,398 | 10/1982 | Schantz | 91/518 |
| 4,408,518 | 10/1983 | Diel et al. | 91/31 |
| 4,430,926 | 2/1984 | Wallace | 91/516 |
| 4,561,342 | 12/1985 | Calvert | 91/514 |
| 4,622,886 | 11/1986 | Imada et al. | 91/520 |
| 4,683,802 | 8/1987 | Prokop | 91/518 |
| 4,709,618 | 12/1987 | Zongker | 91/516 |

*Primary Examiner*—Robert E. Garrett
*Assistant Examiner*—Thomas Denion
*Attorney, Agent, or Firm*—Pennie & Edmonds

[57] ABSTRACT

The present invention relates to, in combination, a vehicle utilizing a first hydraulic cylinder to operate lifting means and a second hydraulic cylinder to operate end effector means, each of the cylinders including a piston, the pistons when moved toward their "up" sides causing the lifting means and end defector means to move in a first direction and when moved toward their "down" sides causing the lifting means and means to move in a second direction, and a load self-leveling system for the vehicle, the system comprising a pair of fluid flow dividers interposed in flow lines between a source of hydraulic fluid under pressure and the first and second hydraulic cylinders, the flow dividers being structured to direct a greater flow of hydraulic fluid to the first cylinder and a lesser flow to the second cylinder, each of the flow dividers comprising adjustable spool valve means located in flow passages between the source of hydraulic fluid and the first and second hydraulic cylinders.

20 Claims, 4 Drawing Sheets

ADJUSTABLE DIVIDED FLOW SELF-LEVELING SYSTEM

FIELD OF THE INVENTION

The present invention is directed to an adjustable, divided flow self-leveling system for vehicles utilizing hydraulic cylinders, a telescopic lifting hoist, arm or boom, and a material handling attachment or carriage.

BACKGROUND OF THE INVENTION

Typically, a high lift loader, exemplified by Lull U.S. Pat. No. 4,147,263, has an elongated telescopic boom pivotally secured at one end to a vehicle, and a carriage such as a fork lift pivotally secured to the opposite end of the boom. An hydraulic cylinder is used to raise and lower the boom relative to the vehicle and another hydraulic cylinder is used to tilt the carriage relative to the boom. Such vehicles are in common use for building construction and similar purposes.

Because the attitude of the carriage changes as the boom is raised or lowered on its pivot connection to the vehicle, constant adjustment of the flow of fluid to the hydraulic cylinder operating the carriage is necessary to maintain the desired level load carrying position of the carriage. Current methods for maintaining the desired relative positioning of the boom and carriage include mechanical parallelogram systems or mechanical-master/hydraulic-slave loop systems. However, use of these systems is not always possible nor practical.

Lull U.S. Pat. No. 589,950 is directed to a load self-leveling system for a vehicle utilizing hydraulic cylinders to operate a telescopic lifting boom and a material handling carriage in which the system includes a pair of fluid flow dividers interposed between the source of hydraulic fluid under pressure and the hydraulic cylinders operating the boom and carriage. The flow dividers are structured to direct a greater flow of hydraulic fluid to the boom cylinder and a lesser flow to the carriage cylinder, the precise numeric proportions of the flow division being engineered to best suit a particular vehicle, combined with the specific componentry of that vehicle. In addition to the flow dividers, the system includes reversible flow piloted check valves, override control including override relief valves to allow independent adjustments, and matched cylinder area ratios.

While the self-leveling system of the Lull patent is highly useful and a significant improvement over prior systems, when different size material handling units are built, the load leveling system, and in particular the spool valve plugs, for each different unit must be sized accordingly. Thus, from a manufacturing standpoint, a number of valve plugs for such load leveling systems must be made available and maintained in stock. Furthermore, as the load leveling system operates, the parts wear due to the shuttling action of the spool valve plugs. Over a long period of time, this wear can cause a portion of the hydraulic fluid to bypass the plug, thus reducing the efficiency of the flow divider system and necessitating the repair or replacement of the flow divider system. Finally, while the spool valves may be adjusted at the factory for proper operation, there is no simple mechanism for "fine tuning" the system in the field to obtain optimum performance after its installation on the vehicle. If minor adjustments are needed during use of the vehicle, the system must be removed so that the spool valve plugs can be repaired or replaced.

The object of the present invention, therefore, is to provide an improvement upon the system described in the Lull '802 patent application which resolves all of the aforementioned deficiencies in a universally applicable system for automatically maintaining any desired attitude of the material handling carriage attachment relative to the lifting or hoisting boom. In addition, if desired, an override feature can be included to allow independent adjustment of the system.

SUMMARY OF THE INVENTION

The present invention relates to, in combination, a vehicle utilizing a first hydraulic cylinder to operate lifting means and a second hydraulic cylinder to operate end effector means, each of the cylinders including a piston. These pistons, when moved toward their "up" sides, causes the lifting means and end effector means to move in a first direction and when moved toward their "down" sides, causes the lifting means and end defector means to move in a second direction. A load self-leveling system is also provided for the vehicle. This system comprises a pair of fluid flow dividers interposed in flow lines between a source of hydraulic fluid under pressure and the first and second hydraulic cylinders. These flow dividers are structured to direct a greater flow of hydraulic fluid to the first cylinder and a lesser flow to the second cylinder. Each of these flow dividers comprises spool valve means located in a flow passage between the source of hydraulic fluid and the first and second hydraulic cylinders with at least one of the spool valve means including means for adjustment of either the greater or lesser flow of hydraulic fluid.

Preferably, the load leveling system includes a housing for the spool valve means, a pair of "up" and "down" mode inlet-outlet ports in the housing for connection to the source of hydraulic fluid and at least two pairs of "up" and "down" mode outlet-inlet ports in the housing for connection to the first and second hydraulic cylinders, with separate passages connecting one of the inlet-outlet ports to one of the pairs of outlet-inlet ports. Also, the adjustable spool valve means an elongated cylindrical body having a transverse passage between the ends thereof and an axially extending passage in each end. One end of the body has a restricted flow aperture between the transverse passage and the axially extended passage, with the other end of the body located adjacent an aperture which directs a portion of the flow of hydraulic fluid to needle valve means for adjustment of the flow passing therethrough to a predetermined value so as to optimize the performance of the system.

BRIEF DESCRIPTION OF THE DRAWINGS

The invention is illustrated by the accompanying drawings in which-corresponding parts are identified by the same numerals and in which:

FIG. 6 is a section on the line 6—6 of FIG. 5 and in the direction of the arrows.

DETAILED DESCRIPTION OF THE PREFERRED EMBODIMENT

Figure 2:
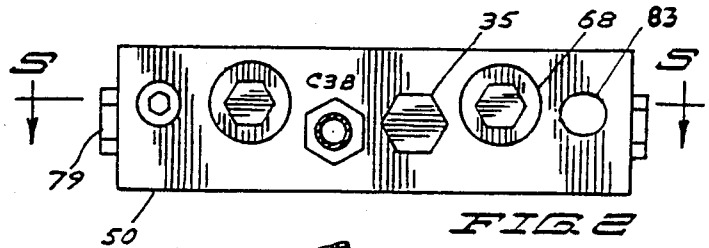
FIG. 2 is a top plan view of a compact assembly valve housing various of the components of the self-leveling system.
Figure 3:
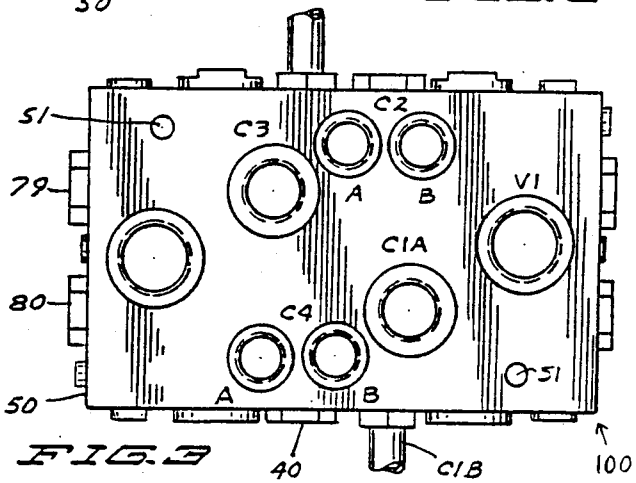
FIG. 3 is a front elevation thereof.
Figure 4:
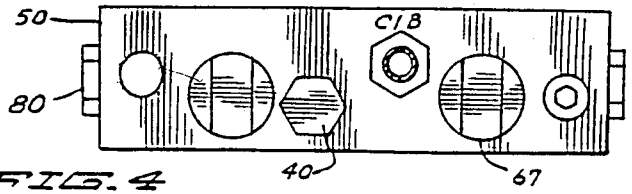
FIG. 4 is a bottom plan view thereof.
Figure 1:
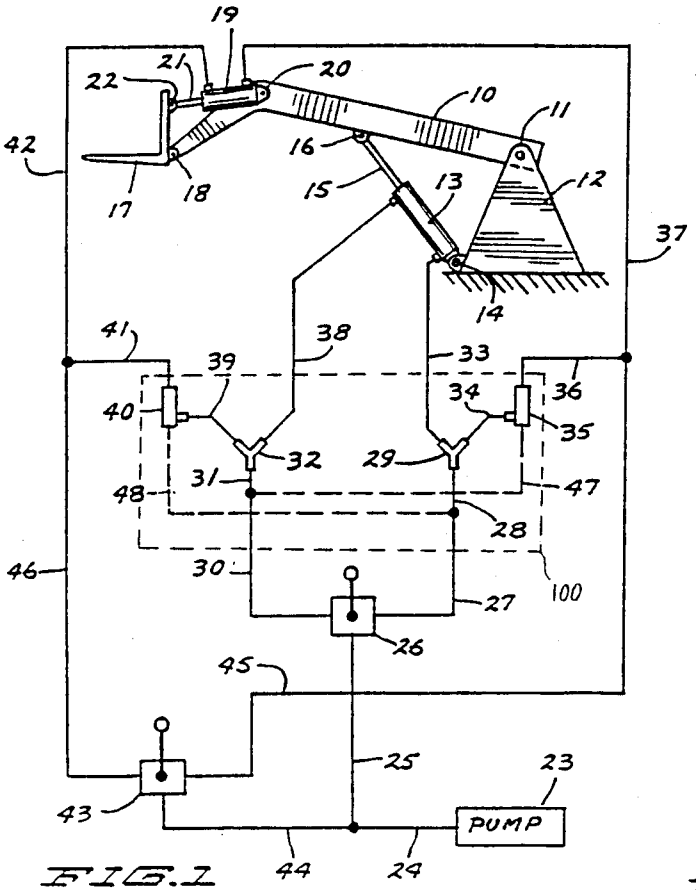
FIG. 1 is a simplified schematic representation of the self-leveling system of the present invention.

Referring now to the drawings, and particularly to FIG. 1, the self-leveling system of the present invention is shown in simplified schematic form. According to current practice, a telescopic lifting hoist or boom arm 10 is pivotally connected at 11 in a frame 12 carried by a vehicle (not shown, but which may be a vehicle such as shown in Lull U.S. Pat. No. 4,147,263). Boom 10 is raised and lowered by means of an hydraulic cylinder 13 pivotally connected at 14 to the vehicle frame. Rod 15 of the cylinder is pivotally connected at 16 to the boom 10. End effector means, here shown as a fork 17, is pivotally connected at 18 to the opposite end of boom 10. Fork 17 is tilted about pivot 18 by means of a tilt cylinder 19 pivotally connected at 20 to boom 10. The rod 21 of cylinder 19 is pivotally connected at 22 to the fork 17.

The term "end effector means" is used herein to generally describe any load carrying apparatus which is attached to the forward end of the boom 10, which apparatus must be maintained at a predetermined angle throughout the lifting cycle of boom 10. Such apparatus include forks (as shown), buckets, personnel carrying baskets, towers, and the like. Also, "end effector means" contemplates tools, such as drills and augers, which may be positioned at a remote work site and which must be maintained in a particular orientation to carry out their appropriate function.

As is well understood, current practice is to direct hydraulic fluid to the piston ends of cylinders 13 and 19 during the boom "up" mode of operation and to the rod end during the boom "down" mode. Since the volume requirements of hydraulic fluid under pressure of the boom and carriage are reasonably proportional throughout the operating range, the object of the system of the present invention is to utilize an adjustable, divided flow of oil or comparable hydraulic fluid to create a condition of self-leveling. The exactness to which such a system operates is dependent on the geometric results of incremental length changes of the operating cylinders and the accuracy obtainable from the flow dividing devices under variable pressures and rates of flow. For example, spool valves generally operate more precisely at higher fluid flow due to the presence of higher fluid pressure differentials. This invention provides adjustment means, preferably associated with each spool valve, to "fine-tune" the flow ratios in order to obtain more accuracy in the parallelism, that is, the attitude of the end effector means is precisely controlled and maintained throughout the entire boom raising and lowering cycle.

Although for ease of explanation the system is shown as including one boom hoist cylinder and one end effector tilt cylinder, in many or most instances a pair of hoist cylinders are used and a pair of tilt cylinders may be used.

Hydraulic fluid, such as oil, flows under pressure from a reservoir through pump 23 and through flow lines 24 and 25 to a manually operable boom hoist control valve 26 by which the mobile loader operator controls the upward and downward movement of the boom 10. From control valve 26, the oil is directed through flow lines 27 and 28 to a first flow divider 29, or through flow lines 30 and 31 to a second flow divider 32. The first flow divider 29 controls the "up" mode of operation of the boom and the second flow divider 32 controls the "down" mode. As explained in greater detail hereinafter, in the "up" mode, the greater proportion of oil in pumped through flow line 33 to the piston side of hoist cylinder 13 to elevate boom 10. The lesser proportion of oil is pumped through flow line 34, check valve 35 and flow lines 36–37 to the piston side of the end effector means tilt cylinder 19. During the "down" mode, the greater proportion of oil flow from the second flow divider 32 is pumped through flow line 38 to the rod side of hoist piston 13. The lesser portion of oil flow is pumped through flow line 39, check valve 40 and flow lines 41–42 to the rod side of the tilt cylinder 19.

It is common practice for hydraulic cylinders to contain pilot operated safety check valves to retain fluid in the cylinders in the event of hose rupture or similar accident. As fluid is introduced to one side of the piston in a cylinder, there is a reverse flow of the fluid from the opposite side of the piston through the flow circuitry back to a reservoir. The pressure exerted by the incoming fluid must be sufficient to overcome the safety check valves to permit reverse flow.

Tilting of fork 17 independently of up or down movement of the boom is accomplished by means of a manual tilt control valve 43. Oil from pump 23 passes through flow lines 24 and 44 to the manual control 43. To tilt fork 17 forward, oil is pumped through flow lines 45 and 37 to the piston side of tilt cylinder 19. To tilt fork 17 backwardly, oil is pumped through flow lines 46 and 42 to the rod side of tilt cylinder 19. Check valves 35 and 40 function whenever the carriage is being independently adjusted to prevent the inadvertent flow of oil to the boom operating cylinder through the flow dividers.

The check feature of valves 35 and 40 is removed for reverse flows during the self-leveling mode by pressure generated in the opposite incoming stream. This pressure mechanically opens the check valves 35 and 40 through a pilot control port, as explained in greater detail hereinafter. As an illustration, in the "up" mode, as pressure is exerted upon the piston side of the hoist and tilt cylinders, a reverse pressure is exerted by the oil being forced from the rod sides of those cylinders. The oil from the rod side of tilt cylinder 19 is permitted to flow backwardly through check valve 40 because of the greater pilot pressure on that valve due to connection to the hoist pressure line.

In FIG. 1, box 100 defines the unitary combination of the various components which are preferably used as a single compact valve assembly as further described in the preferred embodiments illustrated in FIGS. 2–6.

An override control enables the operator to change the attitude of the end, effector means at any time, even during the self-leveling mode. As seen in FIG. 1, the oil directed by the override control is brought into the system downstream of the flow dividers 29 and 32 by means of flow lines 47 and 48, respectively. Override relief valves are incorporated in the body of the override control and serve to relieve divided oil flow in the event the carriage cylinder comes to the fully extended or collapsed configuration. Otherwise the boom cylinder would stop the instant the tilt cylinder stopped.

The cylinder area ratios are intentionally matched to produce the same geometric changes in both the "up" and "down" modes. This prevents any error in flow division or compensation from accumulating on each cycle.

Referring now to FIGS. 2 through 6, there is shown a compact valve assembly 100 incorporating in a single housing 50 two flow divider valves, six check valves and associated ports, flow lines, and connections, and two needle valves and associate orifices and passages for adjusting the fluid flow through the flow divider valves. The housing 50 is a unitary rectangular block of steel or aluminum generally having at least two holes 51 for mounting the assembly 100 to the vehicle.

The valve assembly 100 includes a plurality of ports, each to be provided with a standard fitting for connection to a hose for hydraulic fluid. The ports are as follows:

V-1 for connection to the oil flow line between the manual operating control and "up" mode flow divider;

V-2 for connection between the manual operating control and "down" mode flow divider;

C-1 for connection to the oil flow line between the "up" mode flow divider and the piston side of the hoist cylinder. port and those below are provided with two entries A and B for connection to parallel pairs of cylinders;

C-2 for connection to the flow line between the "up" mode flow divider and piston side of the carriage tilt cylinder;

C-3 for connection to the flow line between the "down" mode flow divider and the rod side of the hoist cylinder; and C-4 for connection to the flow line between the "down" mode flow divider and the rod side of the carriage tilt cylinder.

Flow divider 29 is in the form of a spool valve housed with a valve housing. (References to vertical and horizontal, upper and lower, and like expressions, pertain solely to relationships shown in the drawings. The orientation of the valve housing on the vehicle is immaterial.) Passage 52 communicates with three concentric enlarged diameter annular passages 53, 54, 55. Annular passage 53 is located approximately midway between the ends of passage 5.2 and communicates directly with port V-1 and a flow line passage 56 to check valve 40 (see FIG. 6). Annular passage 54 communicates with ports C-1 A and B, and, through a short passage, with spring biased ball check valve 57. Annular passage 55 is connected through a short passage with check valve 35, and, through a short passage with a spring biased ball check valve 58.

Flow divider spool valve 29 has a constricted throat in its mid-section through which transverse passage 59 extends. Both opposite ends of the spool valve are open and contain flow passages 60 and 61. Passages 59 and 60 are interconnected through a relatively larger axial passage 62, while passages 59 and 61 are connected through needle valve assembly 63, which although adjustable, is of a relatively smaller aperture then passage 62. These apertures of varying size accomplish the desired flow dividing function. Larger aperture 62 is sized to permit the passage of about 70 to 90 percent of the oil flow while a smaller oil flow amounting to about 10 to 30 percent passes through needle valve assembly 63 with flow divisions typically being on the order of 80–86/14–20.

Figure 5:
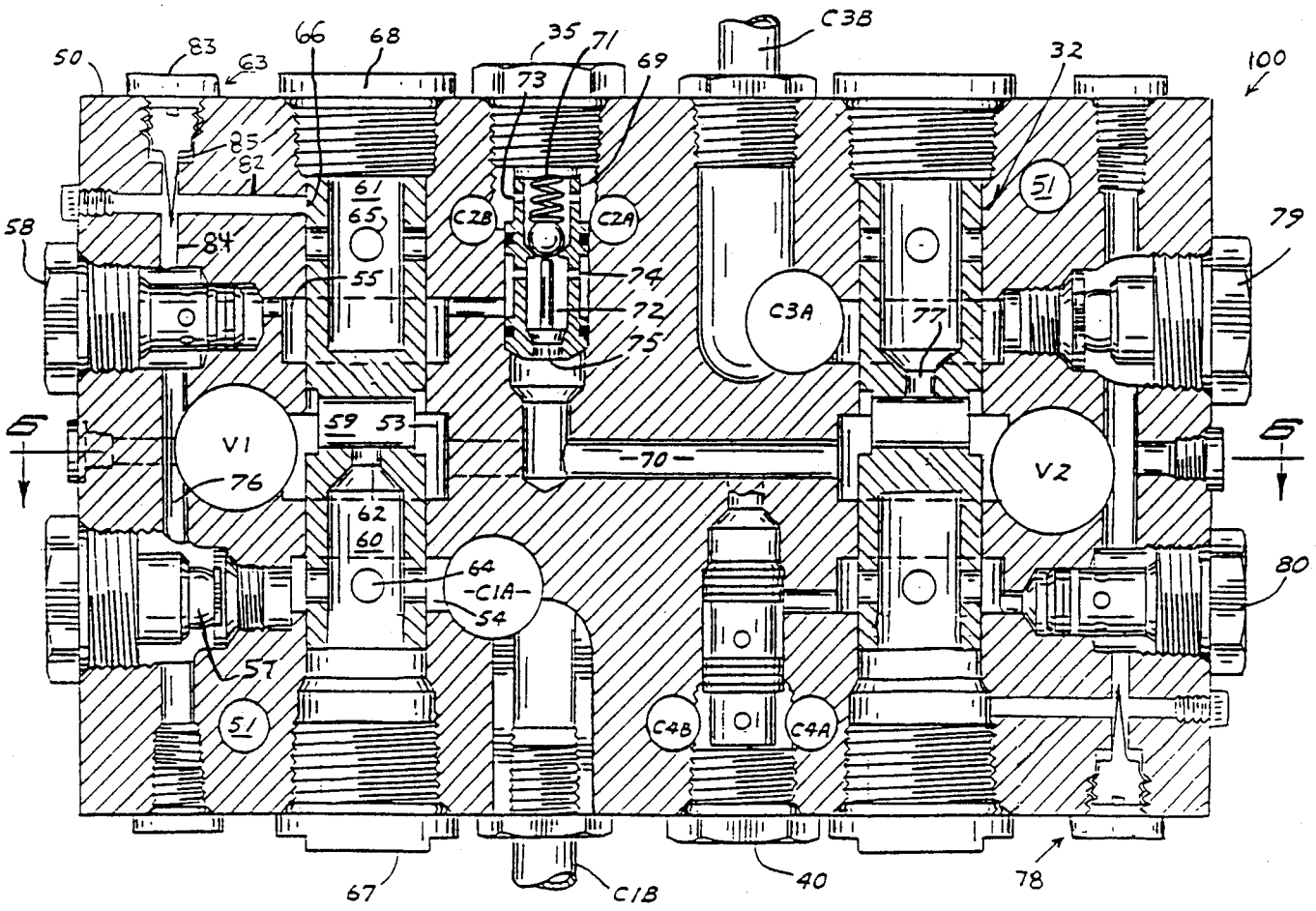
FIG. 5 is a section, on an enlarged scale, on the line 5—5 of FIG. 2 and in the direction of the arrows showing in detail the internal structure of the assembly and the components housed therein.
Figure 5:
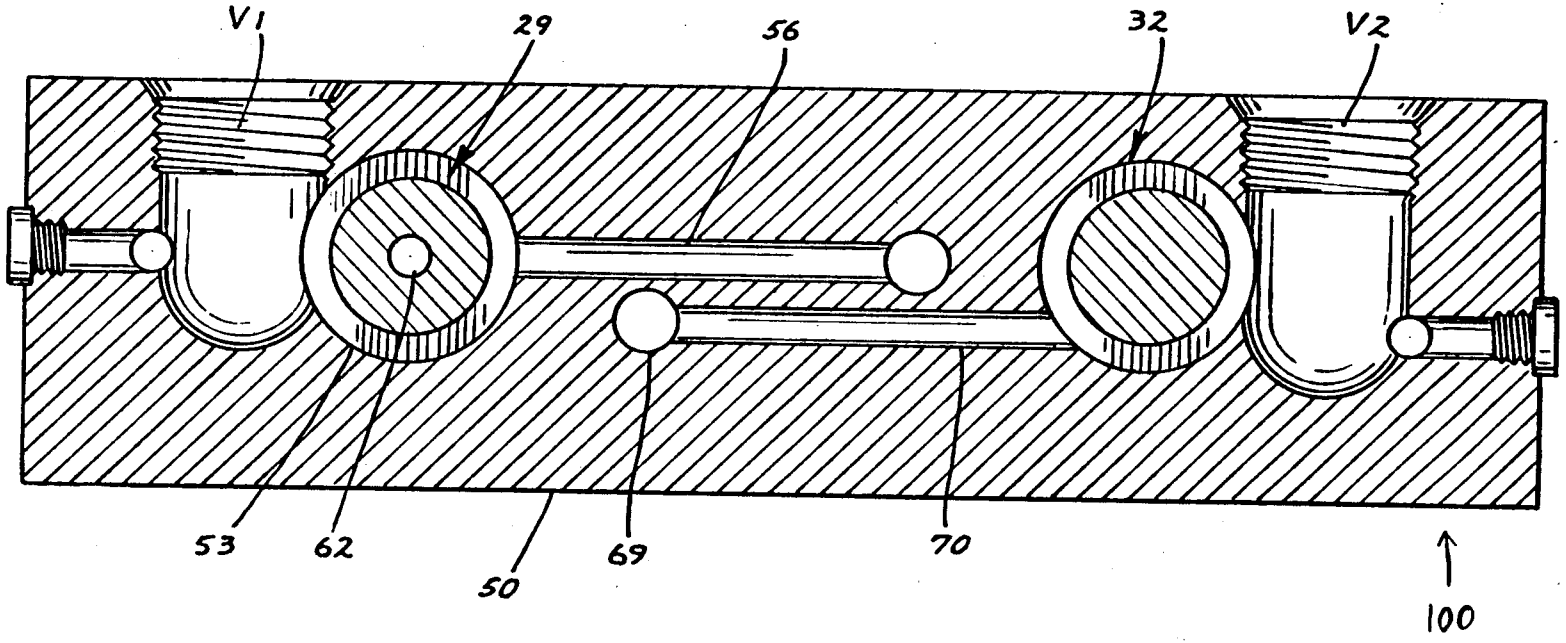

A plurality of flow passage holes 64 permit flow of oil between spool passage 60 and annular passage 54 and thence to hoist cylinder 13. Similarly, a plurality of passage holes 65 permit flow of oil between spool passage 61 and annular passage 55 when the position of the spool valve is shifted, downwardly as seen in FIG. 5, to bring the passages into direct fluid communication, and thence through check valve 35 to tilt cylinder 19.

The ends of passage 52 are closed by gasketed screw plugs 67 and 68. The spool valve may be removed, for example, by removing plug 67, as for cleaning.

The reciprocation of the flow divider spool valve 29 in passage 52 permits prioritizing of oil flow. With the spool valve in the position shown, with the initial surge of pressure due to inward flow of oil through port V-1, the flow of oil is into annular passage 53, transverse passage 59, aperture 62 and passages 60, 64 and 54 to ports C-1 and flow line 33 (FIG. 1 and FIG. 7) to initiate the hoisting action prior to tilting of the fork 17. As the pressure builds, the spool valve is reciprocated to bring passages 65 and 55 into communication to then permit the lesser flow of oil through needle valve assembly 63 and passages 61, 65 and 55 to check valve 35 and ports C-2 to the tilt cylinder.

Needle valve assembly 63 includes aperture 66 on passage 52, and a first flow passage 82 to a needle valve having valve stem 85. At this valve, a second flow passage 84 directs the flow to check valve 58. Thereafter, the lesser flow of oil proceeds to passage 55 and eventually to the tilt cylinder 19 as previously described.

The needle valve is mounted in housing 50 in a manner such that the position of stem 85 can be simply adjusted externally to "fine tune" the amount of flow to the tilt cylinder 19. This enables the attitude of the end defector means to be precisely maintained at a predetermined angle throughout the boom lifting and lowering cycle. Without a precisely controlled amount of flow to the tilt cylinder, the attitude of the end defector means can drift during operation of the boom. Since manufacturing tolerances are not sufficiently precise to enable a sufficiently high degree of control, the needle valve assembly 83 is used to obtain the optimum flow values.

In addition, the operation of the self-leveling system over time cause wear to the spool valve and cylinder seals, which wear causes an imbalance of flow division throughout the system. The needle valve 83 allows simple adjustment of the imbalanced flow back to the desired value without the need for replacing or rebuilding the worn parts. To effect such adjustments, end cap 83 is removed, thus allowing access to the valve by an operator for changing the degree of insertion of valve stem 85.

The incorporation of adjustable needle valves into the system enables its use on a wider variety of machines requiring different flow divisions without the necessity of providing different spool valves. This simplifies the manufacture of the device and avoids stocking different size spool valves which makes it more economical in relation to those systems utilizing non-adjustable spool valves.

Check valves 35 and 40 are identical in structure. They are standard purchased, pilot operated, spring biased ball checks, as shown particularly with respect to valve 35. Check valve cartridge 35 is housed in a passage 69 divided into three sections by means of O-ring fittings. The lowermost end of the passage 69 is connected through passage 70 to port V-2. The uppermost section is connected to ports C-2 A and B which connect to the carriage tilt cylinder. The interior of the valve is separated into two chambers 71 and 72. The upper chamber 71 communicates with passage 69 through a plurality of passage holes 73. It communicates with the lower chamber 72 through a valve seat normally closed by a spring biased ball valve element. The lower chamber 72 communicates with the middle section of passage 69 through a plurality of passage holes 74. Lower chamber 72 communicates also with passage 70 through a valve seat closed by a stemmed pilot disc valve element 75. Operation of the pilot valve 75 removes the check feature of check valve 35 for reverse flow during the self-leveling mode by virtue of pressure on the pilot valve generated by the incoming stream of oil from the opposite sides of the operating cylinders.

Once the spool valve reciprocates to its lower position, the smaller portion of the flow of oil through needle valve assembly 63 from passage 61 is directed through annular passage 55, to the middle section of passage 69 of the housing check valve 35, through holes 74 into chamber 72, past the ball check element and through holes 73 to the ports C-2 A and B connected to the piston side of the tilt cylinder.

Check valves 57 and 58 function to permit reverse flows from the operating cylinder to bypass the flow divider spool valve 29. Thus, when the hoist and tilt cylinders are being operated in the "down" mode, the reverse flow of oil from the hoist cylinder enters through ports C-1 A and B into annular passage 54 and thence, bypassing the spool valve, through check valve 57 and passage 76 to port V-1 to the oil reservoir. Similarly, oil from the piston side of the tilt cylinder enters ports C-2 A and B, past the ball check overridden by the pilot valve stem, through passages 74 to annular passage 55 and check valve 58. Thence, the oil flows through passage 76 to the port V-1.

The structure of the "down" mode flow divider spool valve 32 is basically the same as that of flow divider spool valve 29, already described in detail, with one important exception. The relative positions of the larger flow divider aperture 77 and smaller flow divider needle valve assembly 78 are reversed, as shown. Initiation of the tilt of the carriage in the "down" mode is prioritized over initiation of the lowering of the boom by directing the initial impulse of pressure of the incoming oil flow through port 52 out through check valve 40 to ports C-4 A and B and thence to the rod side of the tilt cylinder 19. This is followed quickly, upon reciprocation of the valve 32 by direction of the larger portion of the divided flow to ports C-3 A and B and thence to the rod side of hoist cylinder 13. Check valves 79 and 80 function in the same manner as their counterparts 57 and 58 to divert reverse flow oil from the rod sides of the hoist and tilt cylinders around the flow divider 32 during the up mode of operation and return it to the oil reservoir through port V-2.

Figure 7:
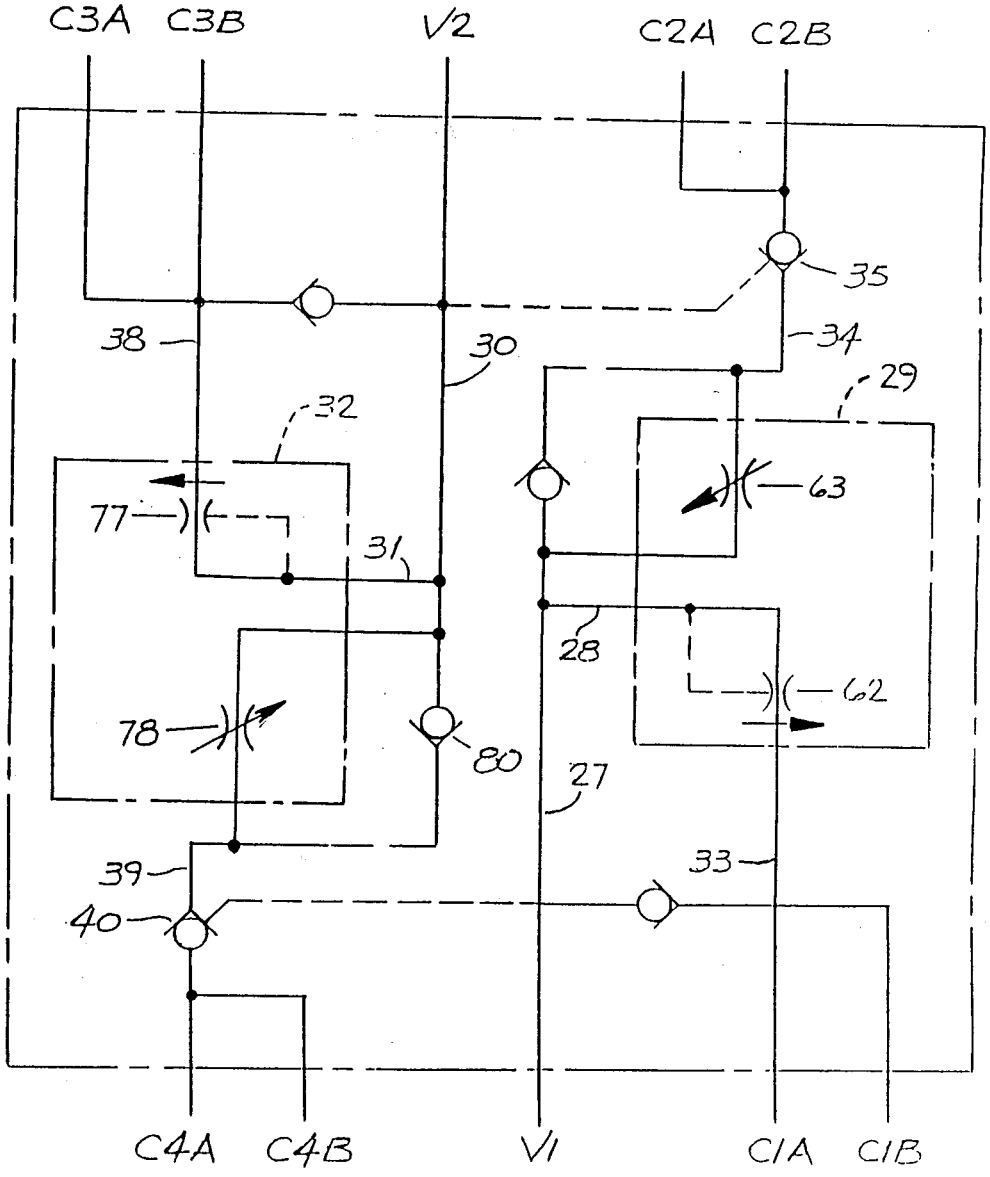
FIG. 7 is a more detailed schematic of hydraulic flow within the valve housing.

The components and flow paths of the compact valve assembly of FIGS. 2–6 are shown schematically in FIG. 7 and related to the flow lines of schematic illustration of FIG. 1. It will be understood that all fittings are made fluid-tight, as by means of O-rings or gaskets or similar sealing materials.

While it is apparent that the invention herein disclosed is well calculated to fulfill the objects above stated, it will be appreciated that numerous embodiments and modifications may be devised by those skilled in the art, and it is intended that the appended claims cover all such modification and embodiments as fall within the true spirit and scope of the present invention.

What is claimed is:

1. In combination, a vehicle utilizing a first hydraulic cylinder to operate lifting means and a second hydraulic cylinder to operate end effector means, each of said cylinders including a piston, said pistons when moved toward their "up" sides causing the lifting means and end effector means to move in a first direction and when moved toward their "down" sides causing the lifting means and end effector means to move in a second direction, and a load self-leveling system for said vehicle, said system comprising a pair of fluid flow dividers interposed in flow lines between a source of hydraulic fluid under pressure and said first and second hydraulic cylinders, said flow dividers being structured to direct a greater flow of hydraulic fluid to the first cylinder and a lesser flow to the second cylinder, each of said flow dividers comprising spool valve means located in a flow passage between said source of hydraulic fluid and said first and second hydraulic cylinders with at least one of said spool value means including needle valve means for minor adjustment of one of said greater or lesser flow of hydraulic fluid.

2. The combination of claim 1 wherein the load leveling system includes a housing for the spool valve means, a pair of "up" and "down" mode inlet-outlet ports in said housing for connection to the source of hydraulic fluid and at least two pairs of "up" and "down" mode outlet-inlet ports in said housing for connection to said first and second hydraulic cylinders, separate passages connecting one of the inlet-outlet ports to one of said pairs of said outlet-inlet ports.

3. The combination of claim 2 wherein the adjustable spool valve means comprises an elongated cylindrical body having a transverse passage between the ends thereof and an axially extending passage in each end, one end of said body having a restricted flow aperture between said transverse passage and said axially extended passage, the other end of said body located adjacent an aperture adjustment the flow which directs a portion of the flow of hydraulic fluid to said needle valve means for passing therethrough between predetermined values so as to optimize the performance of the load leveling system.

4. The combination of claim 2 wherein the housing further comprises a check valve in the flow lines between each of said spool valve means and ports connecting to the "up" and "down" sides of the second hydraulic cylinder.

5. The combination of claim 2 which further comprises a separate passage bypassing said spool valve means located between said inlet-outlet and outlet-inlet ports, and each of said separate passages including a check valve interposed therein.

6. The combination of claim 5 wherein each of said check valves is a pilot actuated valve comprising:

a pair of chambers, a valve seat and spring biased valve element between said chambers, a further valve seat and stemmed pilot valve element closing one of said chambers, and a fluid flow connection between the "up" mode inlet-outlet port to said source of hydraulic fluid and the pilot valve element of the "down" mode check valve, and a further fluid flow connection between the "down" mode inlet-outlet port to said source of hydraulic fluid and the pilot valve element of the "up" mode check valve.

7. The combination of claim 1 wherein each of said spool valve means includes needle valve means for minor adjustments of one of said greater or lesser flow of hydraulic fluid.

8. The combination of claim 1 wherein said vehicle includes said source of hydraulic fluid under pressure, a manually operable flow control valve and a fluid flow line from the fluid source to said valve; and wherein said lifting means comprises elongated boom means pivotally attached at one end to said vehicle, said first hydraulic cylinder and piston is pivotally connected between the vehicle and boom means for lifting said boom means, said end effector means comprises material handling means pivotally attached to the opposite end of the boom means, and said second hydraulic cylinder and piston is pivotally connected between the boom and material handling means for tilting said material handling means.

9. The combination of claim 1 wherein said flow dividers direct about 70 to 90% of the total hydraulic flow to the first cylinder and about 30 to 10% of the total flow to the second cylinder.

10. The combination of claim 1 wherein means are provided whereby the end, effector means may be tilted independently of the lifting means, said means including a manually operable flow control valve, and a pair of flow lines from the control valve to the "up" and "down" sides of the second cylinder piston.

11. In combination, a vehicle utilizing a first hydraulic cylinder to operate lifting means and a second hydraulic cylinder to operate end effector means, each of said cylinders including a piston, said pistons when moved toward their "up" sides causing the lifting means and end effector means to move in a first direction and when moved toward their "down" sides causing the lifting means and end effector means to move in a second direction, and a load self-leveling system for said vehicle interposed in flow lines between a source of hydraulic fluid under pressure and the first and second hydraulic cylinders, said system comprising:

a housing;

a pair of "up" and "down" mode inlet-outlet ports in said housing for connection to said source of hydraulic fluid, and at least two pairs of "up" and "down" mode outlet-inlet ports in said housing for connection to said first and second cylinders, separate passages connecting one of said inlet-outlet ports to one of said pairs of outlet-inlet ports, a pair of spool valve means each being reciprocal in one of said passages connecting said ports for dividing the flow of hydraulic fluid into a greater flow to said first cylinder and a lesser flow to said second cylinder; said spool valve means each comprising:

an elongated body having a transverse passage between the ends thereof and an axially extending passage in each end, and a first end of said body having a restricted flow aperture between said transverse passage and said axially extending passage;

the body of each of said spool valve means having a second end located near an aperture which directs a portion of the flow of the hydraulic fluid to valve means for minor adjustment of the flow passing therethrough so as to optimize the performance of the load leveling system wherein the attitude of the end effector means is maintained at a predetermined orientation during operation of the lifting means.

12. The combination of claim 11 wherein the body of each of said spool valve means has a second end located near an aperture includes needle valve means for minor adjustment of the flow passing therethrough so as to optimize the performance of the load leveling system.

13. The combination of claim 11 which further comprises a separate passage bypassing each of said spool valve means located in the flow lines between said inlet-outlet and outlet-inlet ports, and each of said separate passages including a check valve interposed therein.

14. The combination of claim 11 wherein the housing further comprises a check valve in the flow lines between each of said spool valve means and said ports connecting to the "up" and "down" sides of the second hydraulic cylinder.

15. The combination of claim 14 wherein each of said check valves is a pilot actuated valve comprising:

a pair of chambers, a valve seat and spring biased valve element between said chambers, a further valve seat and stemmed pilot valve element closing one of said chambers, and a fluid flow connection between the "up" mode inlet-outlet port to said source of hydraulic fluid and the pilot valve element of the "down" mode check valve, and a further fluid flow connection between the "down" mode inlet-outlet port to said source of hydraulic fluid and the pilot valve element of the "up" mode check valve.

16. The combination of claim 11 wherein said vehicle includes said source of hydraulic fluid under pressure, a manually operable flow control valve and a fluid flow line from the fluid source to said valve; and wherein said lifting means comprises elongated boom means pivotally attached at one end to said vehicle, said first hydraulic cylinder and piston is pivotally connected between the vehicle and boom means for lifting said boom means, said end effector means comprises material handling means pivotally attached to the opposite end of the boom means, and said second hydraulic cylinder and piston is pivotally connected between the boom and material handling means for tilting said material handling means.

17. The combination of claim 11 wherein said self-flow leveling system directs about 70 to 90% of the total hydraulic to the first cylinder and about 30 to 10% of the total flow to the second cylinder.

18. The combination of claim 11 wherein means are provided whereby the end, effector means may be tilted independently of the lifting means, said means including a manually operable flow control valve, and a pair of flow lines from the control valve to the "up" and "down" sides of the second cylinder piston.

19. In combination, a vehicle utilizing a first hydraulic cylinder to operate elongated boom means and a second hydraulic cylinder to operate end effector means, each of said cylinders including a piston, said pistons when moved toward their "up" sides causing the boom means and end effector means to move in a first direction and when moved toward their "down"

sides causing the boom means and end defector means to move in a second direction, said vehicle comprising:

elongated boom means pivotally attached at one end to said vehicle, a first hydraulic cylinder and piston pivotally connected between the vehicle, and boom means for lifting the boom means, end effector means pivotally attached to the opposite end of the boom means, a second hydraulic cylinder and piston pivotally connected between the boom means and end effector means for tilting the end effector means, a source of hydraulic fluid under pressure, and a manually operable flow control valve and a fluid flow line from the fluid source to said valve, and a load self-leveling system for said vehicle, said system comprising:

a housing;

a pair of "up" and "down" mode inlet-outlet ports in said housing for connection to aid source of hydraulic fluid, and at least two pairs of "up" and "down" mode outlet-inlet ports in said housing for connection to said first and second cylinders separate passages connecting one of said inlet-outlet ports to one of said pairs of outlet-inlet ports, a pair of spool valve means each being reciprocal in one of said passages connecting said ports for dividing the flow of hydraulic fluid into a greater flow to said first cylinder and a lesser flow to said second cylinder, said spool valve means each comprising:

an elongated body having a transverse passage between the ends thereof and an axially extending passage in each end, and a first end of said body having a restricted flow aperture between said transverse passage and said axially extending passage;

a second end of said body located near an aperture which directs a portion of the flow of the hydraulic fluid to needle valve means for minor adjustment of the flow passing therethrough so as to optimize the performance of the load leveling system wherein the attitude of the end effector means maintained at a predetermined orientation during operation of the lifting means, said self-leveling system directing about 70 to 90% of the total hydraulic flow to the first cylinder and about 30 to 10% of the total flow to the second cylinder;

wherein means are provided whereby the end effector means may be tilted independently of the boom means, said means including a manually operable flow control valve, and a pair of flow lines from the control valve to the "up" and "down" sides of the piston of the second cylinder.

20. The combination of claim 19 wherein the housing further comprises a check valves in the flow lines between each of said spool valve means and ports connecting to the "up" and "down" sides of the second hydraulic cylinder, and said self-leveling system further comprising a separate passage bypassing said spool valve means located between said inlet-outlet and outlet-inlet ports; and each of said separate passages including a check valve interposed therein; and further wherein the end, effector means comprises material handling means.

* * * * *